United States Patent [19]

Farmerie

[11] Patent Number: 4,896,462

[45] Date of Patent: Jan. 30, 1990

[54] MECHANISM FOR BELT SANDERS

[75] Inventor: Joseph G. Farmerie, New Berlin, Wis.

[73] Assignee: Milwaukee Electric Tool Corporation, Brookfield, Wis.

[21] Appl. No.: 211,867

[22] Filed: Jun. 27, 1988

[51] Int. Cl.[4] ..... B24B 21/00

[52] U.S. Cl. ..... 51/135 BT; 51/170 EB

[58] Field of Search ..... 51/135 R, 135 BT, 148, 51/170 EB

[56] References Cited

U.S. PATENT DOCUMENTS

| | | | |
|---|---|---|---|
| 1,821,624 | 9/1931 | Emmons | 51/135 |
| 3,497,336 | 2/1970 | Buschman | 51/170 EB |
| 4,115,957 | 9/1978 | Porth et al. | 51/148 |
| 4,177,609 | 12/1979 | Rameckers et al. | 51/135 BT |

*Primary Examiner*—Judy J. Hartman

*Attorney, Agent, or Firm*—Bayard H. Michael

[57] ABSTRACT

A roller carrying yoke is mounted on the base of the belt sander for pivotal movement about a pivot screw as controlled by the adjusting mechanism which includes a carriage bolt non-rotatably mounted in a slot in the yoke. The slot allows movement of the yoke relative to the bolt. The bolt projects through a hole in the housing and threads into the knob. A spring compressed between the yoke and the housing frictionally loads the knob so it holds adjustment. The yoke moves the roller away from the fixed roller until the roller engages and is limited by a belt. Then the loading spring is stretched to tension the belt. The tension spring force is cancelled out as the lever is actuated to pull the roller back for belt removal. When the cam follower on the yoke engages the cam (operated by the lever) the spring length remains constant and the actuating force is minimal.

2 Claims, 3 Drawing Sheets

MECHANISM FOR BELT SANDERS

BACKGROUND OF THE INVENTION

Belt sanders provide for adjustment of one of the rollers to ensure that it is parallel to the other roller so the sanding belt will run true and not run off the rollers. The typical adjusting mechanism has an adjusting knob which bears against a yoke on which the roller is mounted, spring which bears on the yoke to push it against the adjusting screw, and another spring loads the adjusting knob so that it will not change its setting.

CROSS-REFERENCE TO RELATED APPLICATION

The present construction is shown in conjunction with a belt sander having a novel tensioner release mechanism which is claimed in co-pending Application Ser. No. 211,866, filed 6/27/88, assigned to applicant's assignee.

SUMMARY OF THE INVENTION

The object of this invention is to simplify the construction by way of reduction of parts.

The present construction utilizes a compression spring acting between the yoke and the housing to impose a spring load on the yoke pushing the yoke in one direction while a carriage bolt extending between the yoke and an adjusting knob is turned to adjust the position of the yoke.

BRIEF DESCRIPTION OF THE DRAWINGS

FIG. 1 shows the front roller angled with respect to the position it should occupy.

DETAILED DESCRIPTION OF THE DRAWINGS

Figures 1, 2, 3, 4:
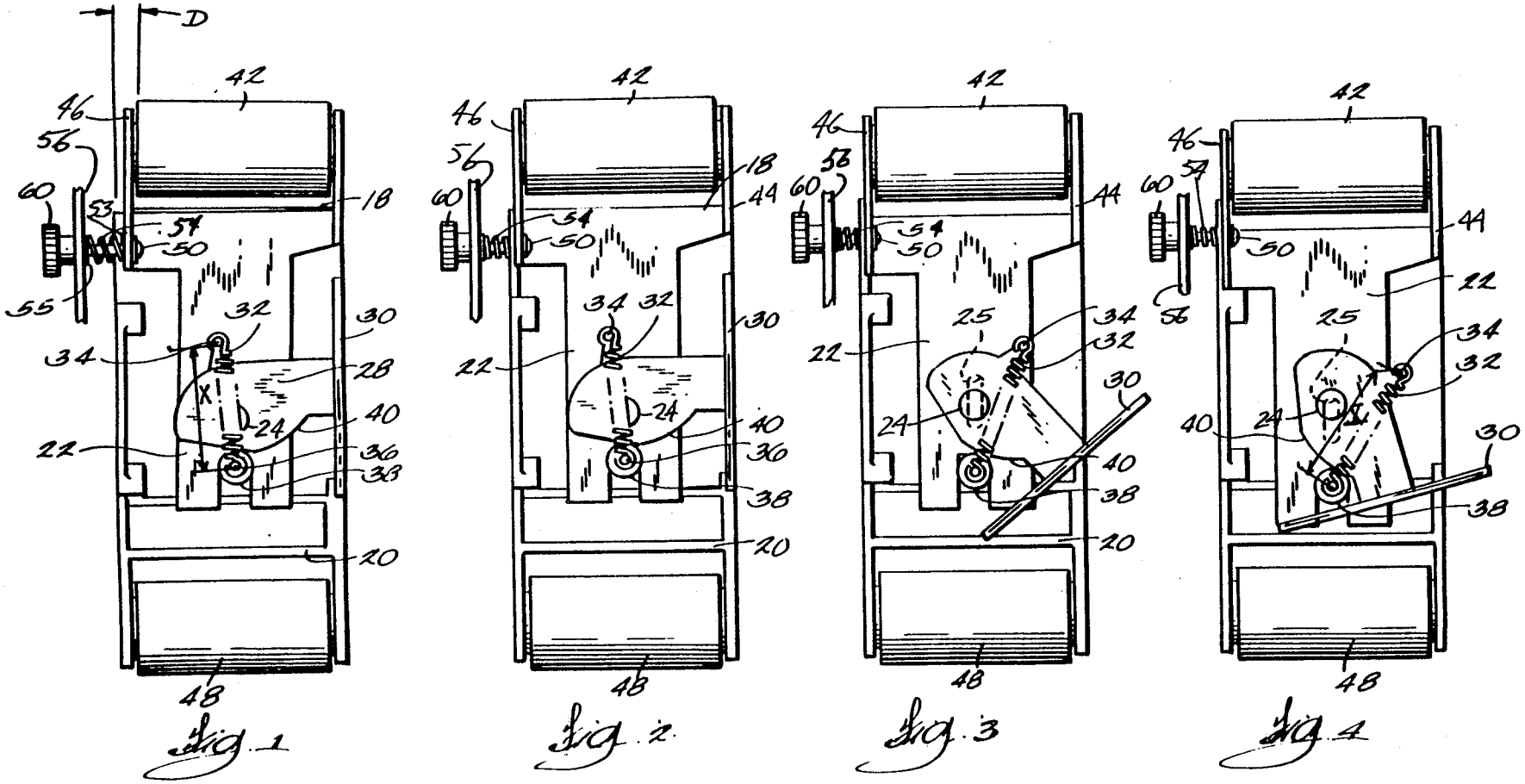
FIG. 1 is a simplified plan view showing a belt sander provided with both an improved tracking and biasing mechanism and a constant force tensioner release mechanism.
In FIG. 2 the front roller has been adjusted into parallelism with the rear roller.
In FIG. 3 the release mechanism lever has been actuated partially to start withdrawing the front roller to relieve the tension on the belt.
FIG. 4 is similar to FIG. 3, but shows the front roller fully retracted.
Figure 5:
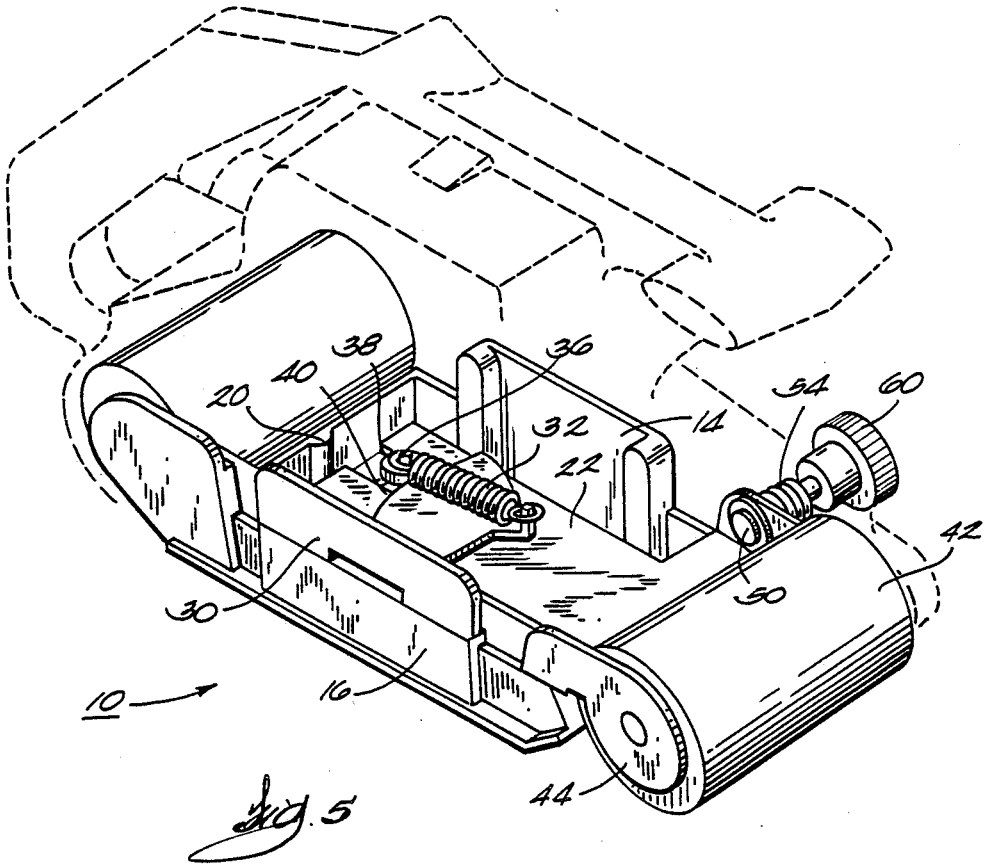
FIG. 5 is a perspective view looking down on the assembled base with the upper housing and handle shown in dashed lines for orientation purposes.
Figure 6:
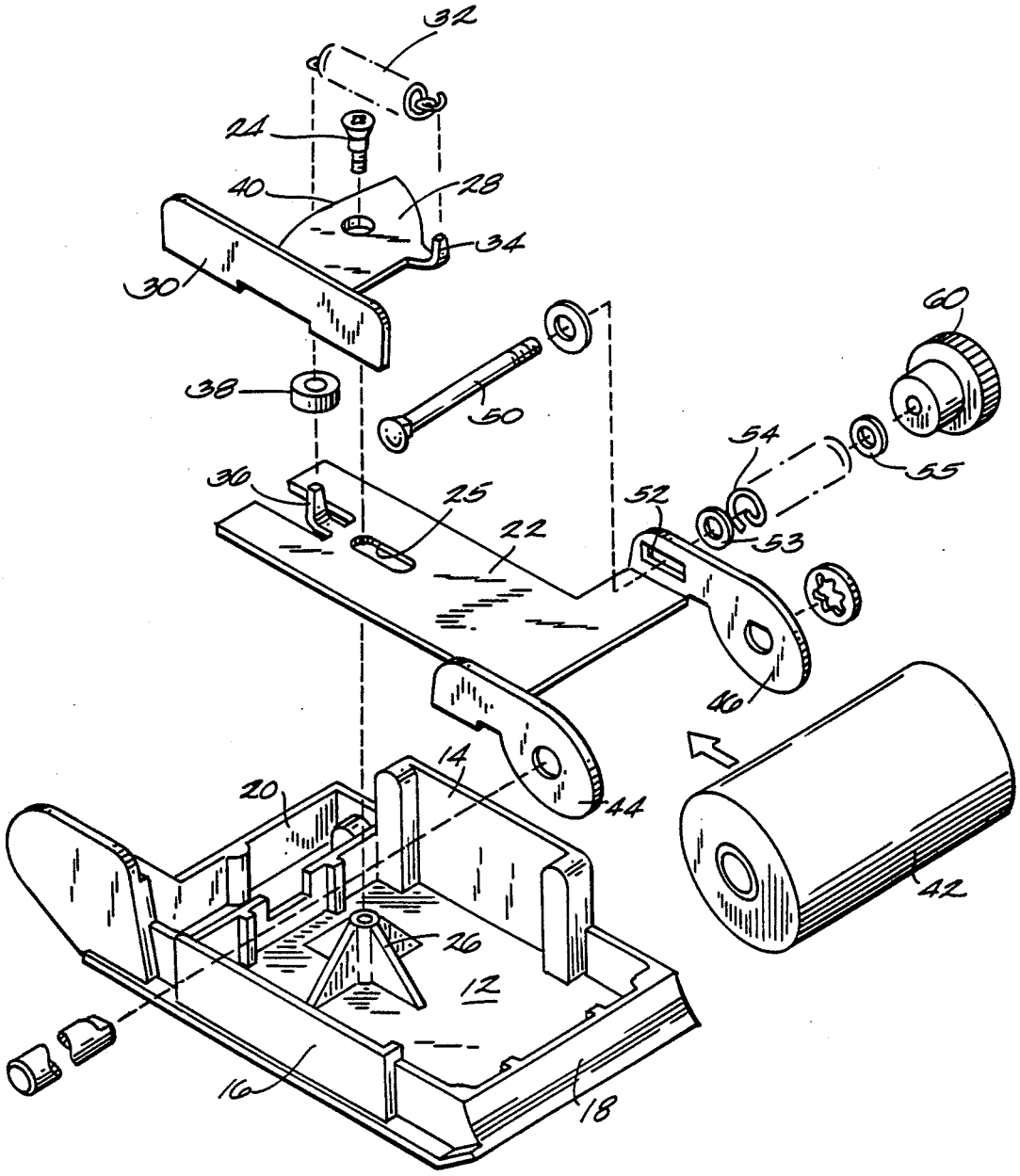
FIG. 6 is a partial exploded perspective view of the construction.

The belt sander 10 has a base 12 having side walls 14, 16 and end walls 18, 20. In FIGS. 1 through 4 the top of the figure is the front of the sander and in FIGS. 5 and 6, the right side is the front. A yoke 22 is slidably mounted for fore and aft for reciprocating movement and for limited pivotal movement on pivot screw or pin 24 which extends through slot 25 and threads into the boss 26 molded in the base. A release lever 28 is also pivoted on screw 24 and has actuator portion 30 which lies at the side of the tool and can be actuated as illustrated in FIGS. 2, 3 and 4. A spring 32 is tensioned between finger 34 on the lever 28 and the finger 36 turned up from the yoke. Both points move and that differs from the prior art. The finger 36 also supports the anti-friction rolling element or bearing 38 which is engaged by the contoured cam 40 of the lever 28. The bearing functions like a cam follower. The adjusting movement of the yoke will be described later.

Referring to FIGS. 2, 3 and 4, it will be noted that as the lever 28 is rotated clockwise about pivot screw 24, the cam 40 bears against rolling element 38 to push the element and finger 36 downwardly to move the yoke 22 downwardly. That means the belt roller 42 journaled on the supports 44, 46 projecting forwardly from the yoke is moved downwardly towards the rear roller 48 journaled on the base 12. This will take tension off the sandpaper belt and permit changing the belt. During this movement, it will be noted the distance X between fingers 34 and 36 (which are the anchor points for the spring 32) does not change . . . it remains constant at X. Therefore, no force has to be exerted to change the belt except for the minimal force necessary to move the parts. When the lever 30 is moved back to its normal position in FIG. 2, the roller 42 will want to lie farther away from roller 48 than is permitted by the belt. Therefore, spring 32 will be stretched to impose a load on the belt to tension the belt and achieve the necessary drive friction. The drive is through the rear roller.

A more detailed analysis is now appropriate. In FIGS. 2–4 no belt is shown so yoke roller 38 is always pulled against cam 40 by spring 32. The force of spring 32 is cancelled out. If a sanding belt restricts movement of roller 42 away from roller 48 the bearing 38 is moved from cam 40 and the spring 32 acts to tension the belt. The spring force acting on finger 34 is to the left of pivot 24 and biases lever 28 counterclockwise to hold the lever 28 against the side of the sander as in FIG. 2. When the lever is moved towards the FIG. 3 position the spring force goes over center and becomes clockwise in the opening direction to assist opening. Somewhere around the FIG. 3 position the yoke bearing 38 would go solid against the cam 40 and the spring force would cancel out. When putting on a new belt both the motion and forces reverse at about FIG. 3 position. The belt is tight and the resisting spring force increases until going over center to FIG. 2 where the spring assists closing the lever. The force needed at the lever is less than the force applied to the belt due to the leverage of the lever. Without a sanding belt, the spring distance is always X and is always cancelled out.

It is necessary that roller 42 be parallel to roller 48; otherwise the belt won't track right and will run off the ends. Therefore, there has to be some way to adjust the front roller to be parallel with the rear roller. In FIG. 1 the front roller 42 is out of adjustment by the distance D. Carriage bolt 50 extends through the slot 52 in the support arm 46 on the yoke. The carriage bolt may be termed a threaded pin. The usual "square" under the head of the bolt engages the slot to prevent rotation of the bolt and cooperates with the edges of slot 52 to guide the reciprocating movement of the yoke 22. Spring 54 fits over the shank of the bolt 50 and is compressed between the support arm 46 and the housing 56 which is a part of the cover and handle assembly shown in dotted lines in FIG. 5. Washers 53 and 55 provide bearing surfaces for spring 54. The carriage bolt extends through the hole in the side wall 56 and is threaded into the adjusting knob 60. When the adjusting knob 60 is tightened, it acts as a nut on the carriage bolt and pivots the yoke towards the knob. When the knob is loosened, the spring between the housing and the yoke pushes the yoke away from the knob. The knob is turned to adjust the roller 42 until it is parallel with the rear roller 48.

I claim:

1. A belt sander comprising, a base, a drive roller mounted on one end of said base, a vertical pivot pin mounted on said base, a generally horizontally disposed yoke having a longitudinally oriented slot therein at one end mounted over said pin to enable the yoke to slide and pivot axially relative to said pin, said yoke including spaced, generally vertical support arms at the other end of said yoke, an idler roller rotatably mounted between said arms, said idler roller being longitudinally spaced from said drive roller, an endless belt mounted on said drive roller and said idler roller, a housing fixed relative to said base and including a generally vertical side wall, a generally longitudinally disposed slot in one of said arms, a threaded, heated pin slideably but non-rotatably mounted in said slot in said one arm and having its threaded end projecting outwardly through said side wall, a knob threaded on said pin outside said housing, and a spring compressed between said side wall and said one arm to bias said one arm against the head of said pin and to hold said knob against the outside of said housing so turning said knob adjusts said yoke about said pivot pin to angularly align said belt.

2. A belt sander according to claim 1 in which said threaded pin is a carriage bolt having a portion having a rectangular cross-section engaging said slot in said one arm to restrain the threaded pin against rotation.

* * * * *